United States Patent [19]

Mathieu et al.

[11] 4,106,298

[45] Aug. 15, 1978

[54] DEVICE FOR THE PRODUCTION OF EARTH HOLES

[75] Inventors: Hans Mathieu, Bischmisheim; Jürgen Hochstrasser, Stengelstrasse, 6, 66 Saarbrucken 1, both of Germany

[73] Assignees: Elizabeth Hochstrasser nee Wack; Jürgen Hochstrasser, both of Fed. Rep. of Germany

[21] Appl. No.: 735,589

[22] Filed: Oct. 26, 1976

[30] Foreign Application Priority Data

Nov. 7, 1975 [DE] Fed. Rep. of Germany ..... 2550595

[51] Int. Cl.[2] ..... E02D 11/00

[52] U.S. Cl. ..... 61/53.64; 61/53.5; 61/56.5; 173/126

[58] Field of Search ..... 61/53.5, 53.52, 53.64, 61/53.66, 56.5, 53.7, 63; 173/126, 139

[56] References Cited

FOREIGN PATENT DOCUMENTS

| | | | |
|---|---|---|---|
| 109,310 | 9/1964 | Netherlands | 61/53.5 |
| 398,050 | 9/1933 | United Kingdom | 61/53.64 |
| 410,280 | 5/1934 | United Kingdom | 61/53.64 |

*Primary Examiner*—Jacob Shapiro
*Attorney, Agent, or Firm*—Basile and Weintraub

[57] ABSTRACT

A device which includes a ram and a tube, which device can be used for the production of earth holes and poles which are located in these holes and which poles are made of poured or compressed concrete and a process using this device.

17 Claims, 6 Drawing Figures

DEVICE FOR THE PRODUCTION OF EARTH HOLES

BACKROUND OF THE INVENTION

I. Field of the Invention

The invention concerns a device which includes a ram and a tube, which device can be used for the production of earth holes and poles which are located in these holes and which poles are made of poured or compressed concrete and a process using this device.

II. Description of the Prior Art

It is known that for the purpose of drilling holes into the earth for actually any purpose, a tube can be driven into the earth with a ram, which consists of a free-falling ram guided by guides and located on a pile driver. The ram is intermittently lifted by the pile driver and hits in free fall the frontal plane of the tube to be driven.

In order to be able to remove the earth from the tube, the ram must be shut off in the range of the drilling crane after the tube has been driven a certain distance, and the support must be disconnected in order to be able to connect to the rope of the crane an earth remover or a gravel and sand pump, with the aid of which the earth is removed from the tube. Then the earth remover is disconnected from the rope, and the ram is connected to this rope in order to be able to continue with the driving of the tube into the earth. In order to avoid this exchange between the ram and the earth remover, which has to be repeated, a ram is known, which is constructed in a cylindrical fashion in order that concurrently with the ramming operation an earth remover can be inserted into the tube through the cylindrical opening of the ram with a second rope in order to remove the earth from the tube. This known ram is equipped with a shoulder, which contacts the frontal plane of the tube on impact; and it is further equipped with a cylindrical extension, inserted inside the tube, and which extension serves to guide the ram inside the tube.

Although this known version of the ram, which is shown in West German Pat. No. DT-PS 709 772, permits the concurrent ramming and removal of the earth, which necessitates the use of a crane with two ropes, where one rope is used to generate the lifting movements of the ram, which are necessary for the ramming, whereas the other rope serves for the removal of earth by means of the earth remover, it has various disadvantages. These disadvantages for one thing consist in the fact that the rope, which carries the ram, must perform precise lifting movements of the ram during its continuous downward movement, in order to prevent a loss of contact of the tubular extension of the ram with the tube to be rammed, which would lead to a time consuming interruption of the operation. Although such a precise control of the lifting movements of the ram by means of the rope of the crane is possible, it necessitates the use of additional equipment. Another disadvantage of the known ram consists of the fact that the introduction of the earth remover into the cylindrical opening of the ram is difficult and time consuming, because the crane operator does not always lift right away with the earth remover the cylindrical opening of the ram, which corresponds in its diameter approximately with the dimensions of the earth remover. Furthermore, especially in residential areas, it is necessary to muffle the noise, which is generated when the ram hits the tube. For this purpose, it is known to surround the end of the tube and the ram with a muffler, which must be lowered in its position together with the tube. This muffler renders the upper end of the drilling tube invisible for the drilling personnel, in such a way that it is especially difficult to surely insert the earth remover into the cylindrical opening of the ram. In addition, all known rams can only be used to drive the tube into the earth. When for the purpose of the production of concrete poles the tube has to be removed from the earth after it has been filled with concrete, the substantial static friction between the drilling tube and the surrounding earth is usually impossible for the crane, which was used for the ramming operation. Therefore either a crane must be used, which possesses a substantially higher tractive power, or additional tube retracting devices must be used, which enhance the tractive power of the crane. This is especially true for so-called poured concrete poles. In this case the concrete is poured into the emptied tube, which had been rammed into the earth, and the tube is then removed from the earth. For the production of compressed concrete poles it is known to close the tube, which was rammed into the earth and filled with concrete, in an air-tight fashion, and to form a pocket of compressed air between the lid and the surface of the concrete by passing compressed air through the lid, which pocket of compressed air compresses the concrete. Since the air pocket exerts also a pressure on the inside of the lid, which pressure is directed toward the pulling-out direction, it is known to form a pocket of compressed air of such a pressure, which is capable of overcoming the static friction. For this purpose the lid is equipped with a safety valve (DT-PS West German Pat. No. 1 189 021 of the applicants). The valve lifter of the above valve is connected with the hook of the crane, and the valve is kept in a closed position by the rope and on the other hand by the pressure of the air pocket. The valve lifter is equipped with a disc, which is located in a cell, and which disc possesses a circular area, which is larger than the surface of the lifter head, and the space above the valve disc is connected with the inside of the tube by means of a drilled hole which runs through the valve lifter. In this way the pressure of the air pocket exerts more power on the lifter in the direction of opening, due to the larger area of the valve disc, than the power which is exerted on the lifter head by means of the air pocket. If the static friction of the tube in the earth is overcome by the high air pressure, the danger exists that the tube shoots out of the drilling hole with dynamic friction. In order to avoid the endangering of the personnel, which exists due to the circumstances described above, in this case the valve lifter opens, since the rope tension is practically nil, and the pocket of compressed air is released by means of drilled holes, which lead to the outside. In this way it is guaranteed that only small outwardly directed movements of the tube can occur, due to the influence of the air pocket.

For the production of compressed concrete poles of large lengths of up to 60 meters with diameters of up to 2.50 meters, a method of the applicants is known, which method teaches the attachment of a weighted lever at the end of the tube, which lever is turned back and forth for partial turns, which are limited by stops located on the tube, and which lever is turned back and forth by pneumatic piston-cylinder arrangements. In this way the tube is subjected to impacts and turns, and the tube penetrates the earth under the load, which it is subjected to. The removal of the tube is also performed utilizing the lever, from which the weights are removed by means of a rope which is attached to the tube. The removal of the tube is assisted by the pocket of compressed air, which was described above. This known method is very well suited for the economical production of long poles; however, for small depths and for earth, which is readily penetrable, this method is economically not justifiable.

The same applies to a larger extent for the tubing machines with hydraulic revolving propulsion, which are also known.

SUMMARY OF THE INVENTION

The invention is based on the known device, which teaches the guidance of the ram by means of a cylindric extension in the tube to be rammed; and the invention is further based on the objective to make this device in such a way that a trouble-free and noise-free ramming is guaranteed with the smallest possible effort and with the use of the smallest number of additional parts, in a way that the ram cannot leave the tube during its lifting movements, and with each lowering the earth remover can reliably be inserted by control of vision into the cylindrical opening of the ram, and that during the removal of the tube for the production of concrete poles poured in place, the tube can be subjected to intermittent impacts on the direction of the removal of the tube by means of which impacts the removal of the tube is enhanced in such a way that the use of cranes of low load capacity is possible, applying an air pocket for the production of compressed concrete poles, which serves to compress the concrete with each impact.

In compliance with the invention this objective is met by connecting the tube with the ram by means of yielding devices, which can be detached and which determine the lifting height of the ram; by the formation of a groove at the ring-shaped shoulder of the ram, which serves as a receptable for a noise-muffling buffer and for the reinforced frontal section of the tube; and by the fact that the ram is conically enlarged at its upper end. The devices, which connect the ram and the tube, reliably prevent that the ram can lose contact with the tube during the ramming of the tube, and during the removal of the tube they impart impacts on the tube in the direction of the removal of the tube, when the ram is lifted intermittently, by means of which impacts the removal of the tube is facilitated. The ring-shaped buffer, which consists of an elastic incompressible material, serves to muffle the noise. The size of the elastic distortion of the buffer at the moment of contact with the frontal section of the tube is determined by the spaces, which are located at the sides of the buffer. The conical enlargement at the upper end of the ram guarantees a safe and trouble-free introduction of the earth remover or of the gravel and sand pumps respectively.

One version uses steel cables as connecting devices, which are of such a length that the ram does not lose contact with the tube during the lifting of the ram. For the use of this version a crane is necessary, which is equipped with two ropes, one of the ropes carrying the ram and the other rope serving to handle the earth remover. During the removal of the tube the ram is lifted by the rope. This imparts an impulse on the tube in the direction of removal of the tube by means of the connecting ropes, which are under tension. The ram is moved again to its lower position by a slow downward movement, whereupon a quick lifting movement follows again.

For another version the connecting devices consist of piston-cylinder arrangements, for instance, with the piston connected to the tube and the piston rod connected to the ram. For this version a crane can be used, which is equipped with only one rope. For the erection of the tube the rope is attached to the ram, while the operation of the ram is performed by the piston-cylinder arrangements. When the tube is rammed into the ground using the piston-cylinder arrangement to such an extent that the tube stands, the rope is removed from the ram and connected with the earth remover. The ramming of the tube is performed exclusively by intermittent operation of the piston-cylinder arrangement. For the removal of the tube the ram is lifted by the piston-cylinder arrangements. For appropriate purposes stops are attached to the tube, which exceed in height the upper edge of the ram to such an extent that the ram contacts these stops when it has reached its maximum lift position. In this way the tube is subjected to intermittent impact impulses in the direction of the removal of the tube.

An appropriate and useful version provides both the connecting ropes as well as the piston-cylinder arrangements, since in this way the version is universally applicable. For the purpose of removal of the tube the piston-cylinder arrangements can be loosened and turned downward in such a way that they are supported on the ground and can exert a constant pressure on the tube in the direction of removal in the early stage of the removal, in addition to the removal impulses, which are exerted on the tube by means of the connecting ropes. Layers of materials can be provided between the piston-cylinder arrangements and the ground in accordance with the step-wise removal of the tube.

It is appropriate and useful to design the upper part of the tube in the form of an independent part of the installation, which can be connected with the tube to be rammed by a tight flange. In this way it is possible to use one and the same device, which consists of the independent part of the installation and the ram, for tubes of different diameter. Tubes with a smaller diameter are equipped with a conical collar-shaped enlarged section. The diameter of the upper edge of this section is the same as the diameter of the independent part of the installation.

For the production of poured concrete poles of small depth an unobjectionable and easy removal of the tube with a crane of relative small capacity is possible, since the removal is significantly facilitated by the impacts in the direction of removal to which the tube is intermittently subjected.

The process for the production of poles which are made of compressed concrete, and according to which process the rammed-in tube, which is filled with the concrete to be compressed, is subjected to a power, which is directed toward the direction of removal of the tube, and where an air pocket is formed above the column of concrete, which is located in the tube, is characterized by the fact that the tube is subjected to an impact impulse in the direction of removal subsequent to each compression of the air pocket. For this purpose a groove is provided at the inner wall of the tube or at the part of the installation which is connected with the tube, which groove serves as a receptable for a snap ring, which snap ring serves as a stop; and below the snap ring an axially movable compression-and impact-piston is contained in the tube or in the part of the installation in a tightly fitting fashion, which compression-and impact-piston is equipped with a buffer, at the top, which serves to muffle the noise. The compression-and impact-piston is connected to the ends of the piston-cylinder arrangements which are connected to the tube or part of the installation by means of a piston rod with a side arm in such a way that it is movable in an axial direction by activation of these arrangements. Pulling-ropes are located at the wall of the tube or the part of the installation, which are attached to the hook of a crane, and which pulling-ropes are located at an angle of 90° with reference to the side arm and which are located diametrically with reference to each other. The rammed-in tube, which is filled with the concrete to be compressed, is maintained under tension by the pulling-ropes. In order to obtain an air pocket, which serves to compress the concrete, the piston is moved downward, in such a way that the air, which is located between the piston and the concrete, is compressed and exerts a pressure on the concrete. In this case the piston has the effect of a compression-piston. Subsequently, the piston is moved upward by the piston-cylinder arrangements until the piston touches the snap ring, which is located in the tube. In this way the tube is subjected to an impact impulse in the direction of removal. In this case the air pocket serves exclusively to compress the concrete, and the use of compressed air is not necessary, since the piston functions as an impact piston during this phase and imparts a mechanical impact impulse on the tube, which impulse is directed upward. In order to supply the space between the piston and the concrete with atmospheric air, an air inlet with a valve is located below the piston in the wall of the tube, which valve is opened for a short time during the removal of the tube in certain time intervals when the piston is located in the upper position in order to permit entry for the atmospheric air. The pulling-ropes are attached to known air vents, which are located in rectangular side-tubes, which end at the tube. The use of these safety valves is actually not necessary, since normally atmoshperic air is used for the formation of the air pocket, which serves to compress the concrete. In this way an upward movement of the tube due to the air pocket cannot occur. These known safety valves are provided solely for reasons of safety, in order to be able to vent the tube, in case the tube moves upward due to the air pocket for whatever reasons.

For a different version the compression-and impact-piston is attached to the hook of a crane. It is lowered by the crane in order to obtain an air pocket, and it is lifted to impart the impact impulse on the tube in the upward direction. The piston-cylinder arrangements which are attached to the tube are turned down and are supported on the ground, in such a way that they exert a constant pressure in the direction of the removal of the tube. In this case the addition of atmospheric air occurs through a drilled hole in the piston, which is connected with an air line, which air line is equipped with a valve. The known safety valve is located between the pulling-rope and the compression-and impact-piston. The compression-and impact-piston must of course be of such weight that an air pocket is obtained during its free downward movement above the concrete, which serves to compress the concrete. Since the tractive power which is necessary for the removal decreases with increasing removal of the tube from the ground, it is advantageous to exert an additional pressure on the tube in the direction of removal by the piston-cylinder arrangement during the first part of the removal operation. In this case appropriate layers of material can be provided between the ground and the piston-cylinder arrangements as the tube emerges step by step from the earth.

For tubes which extend into the ground water, the procedure is further characterized by the fact that a pocket of compressed air is moved downward in the tube; that the ground water which is displaced by the air pocket is lifted to a level above the air pocket; that after displacement of the ground water from the tube concrete is introduced into the tube against the pressure of the air pocket resulting in a gradual lifting of the air pocket; and that after introduction of the concrete the air pocket is moved downward in an intermittent fashion and each time the tube is subsequently subjected to an impact impulse in the direction of removal. In order to carry out the procedure the compression-and impact-piston is used, which is suspended from the rope of the crane, and which compression-and impact-piston is equipped with a drilled hole, which extends through the piston and which can be closed, and which faces the ground water, which flexible tube extends underneath the ground water level, and which compression-and impact-piston is furthermore equipped with a piston-permeating, closable tube which serves to add concrete and another piston-permeating, closable tube for air. The compression-and impact-piston is inserted into the rammed-in tube, which is filled with ground water, and lowered in such a way that an air pocket is formed above the water level. If the pressure of the air pocket exceeds the hydrostatic pressure of the ground water, the piston sinks further down. The drilled hole which is equipped with the flexible tube is opened. This results in the formation of a connecting tube, which allows the ground water to rise to the upper surface of the piston, thereby increasing the weight, which rests on the air pocket. In this way the piston sinks further and further down, until the ground water is completely removed from the drilled hole. At this point the connecting tube is closed again and concrete is pumped into the drilled hole against the pressure of the air pocket and through the opening in the piston, which is designed for the addition of concrete. In this way the air pocket is raised together with the level of concrete, which rises in the tube. When the tube is filled with concrete, the piston is lowered and lifted in order to compress the concrete by means of the formed air pocket when the piston is lowered and to impart an impact impulse on the tube in the direction of removal when the piston is lifted. In this way the ground water can be removed from the drilled hole and the tube can be removed with one and the same piston, and the piston-cylinder arrangements can serve to enhance the removal during the beginning phase of the removal. Naturally, the concrete tube must be closed during the removal of the ground water from the drilled hole. This can be achieved, for instance, by a ball valve.

The invention is of advantage especially for the production of poles of relatively little depth, because of its economy, since only tube dredges or cranes of little capacity, which may correspond to the weight of the tube, have to be employed. The invention is also useful in very tight quarters in construction pits and in rough terrain. The parts of the installation are of very low cost and do not cause much noise during operation without rendering the operation difficult and costly, due to the use of hindering mufflers. Due to the compression of the concrete by means of an air pocket and due to the intermittent shaking of the tube caused by the impact impulse during the removal, a very good compression and intimate dove tailing of the concrete with the earth surrounding the pole is achieved, since the concrete is pressed into the earth after every impact impulse. The removal of the tube, which is performed in a jerking fashion, results in the formation of a shoulder and, thus, the friction of the surface of the finished pole in the earth is significantly increased. The compressed shaken poles, which are produced in accordance with the invention, exhibit a substantially higher load capacity than poured concrete poles.

Another significant advantage of the invention consists of the multiple possibilities of utilization of the individual parts of the installation, in a way that they can be universally adapted to all situations and demands as they may occur. In this way the compression-and impact-piston can serve to compress the concrete and to impart impact impulses on the tube. However, it can also be used for the displacement of the ground water in the tube before the concrete is introduced. The piston-cylinder arrangements serve for the driving-in of the tube as well as for the removal of the tube in a different way.

The ram can be applied with the piston-cylinder arrangements, with a crane, a tube dredge or a similar source of power in accordance with the local situation. Compressed concrete poles with different pole diameters, which correspond with the desired load capacities of the poles, can be produced with one and the same ram. For instance, an installation which is designed for a tube of 90 CM diameter can also be used for the production of poles with a diameter of, for instance, 80, 75, 64, 60, 52 or 42 CM.

The attached drawings show examples of versions of the invention and the following applies:

FIG. 1: Cross-section of a device, which serves to ram-in and to remove a tube, with connecting ropes, where the ram is activated by means of a rope from a crane.

FIG. 2: Variation of the version in accordance with FIG. 1 with piston-cylinder arrangements instead of the connecting ropes.

FIG. 3: Another variation for the compression of the concrete and for the removal of the tube.

FIG. 4: Side view in accordance with FIG. 3.

FIG. 5: Another device, which serves for the additional removal of ground water from the tube, and FIG. 6: Drawing in accordance with FIG. 5 during the removal of the ground water.

DESCRIPTION OF THE PREFERRED EMBODIMENTS

Figure 1:
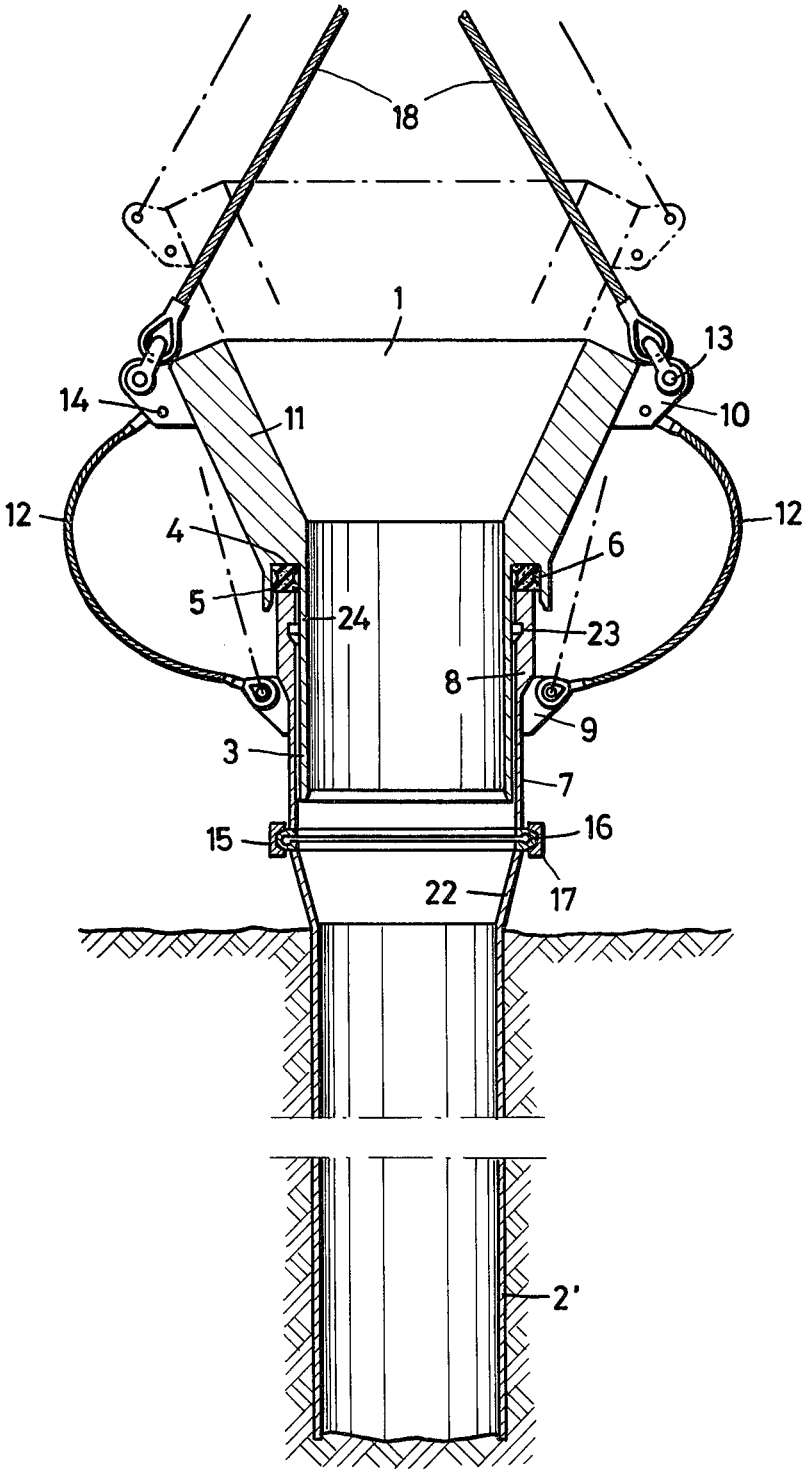

FIG. 1 shows the cross-section of a ram 1, which is equipped at its lower end with a small cylindrical extension 3, and which ram's upper part is shaped in the form of an expanding cone 11. In the ring-shaped shoulder, which is located between the cylindrical extension 3 and the cone 11, a groove 4 is located, which contains an elastic, incompressible buffer 5, which fills the cross-section of the groove 4, and which has a space 6 at both its sides, which are located parallel to the axis of the tube. The distance which the buffers can be compressed is determined by this space 6. The cylindrical extension 3 of the ram 1 is surrounded by a cylindrical part of the installation 7. The length of the part of the installation 7 exceeds the length of the cylindrical extension 3. At the upper section the thickness of the wall of the part of the installation 7 is increased towards the outside. In this way a ring-shaped frontal plane is formed, which contacts the buffer 5, when the ram 1 is lowered. The buffer 5 muffles the noise. At the part mid-section of the installation 7 two brackets 9 are attached in a diametrical fashion opposite each other, while at the upper section of the cone 11 of the ram 1 there are also attached two brackets 10 in a diametrical fashion opposite each other. Flexible steel cables 12 are attached to the brackets 9 and 10. The length of these flexible steel cables corresponds to the lifting height of the ram 1. Above the steel cables 12 the brackets 10 are equipped with eyes 13, which serve for the attachment of cables 18, which are in turn attached to a crane hook, which hook is not shown. The upper ends of the steel cables 12 are connected to the brackets 10 by means of bolts 14. At the lower end of the part of the installation 7 a protruding ring-shaped flange 15 is located. The upper surface of this flange 15 is tapered in a conical fashion. The part of the installation 7 is connected with a tube 2', which is equipped at its upper end with a conical enlargement 22, which in turn is equipped at its edge with a ring-shaped flange 15 (same as above). Between both the ring-shaped flanges a gasket 16 is located, and both the ring-shaped flanges 15 are surrounded by a tightening device 17, which presses both the flanges 15 together by means of a tangentially located tightening bolt (not shown). In this way the tube 2', which exhibits a smaller diameter than the lower part of the installation 7, can be connected with it in order to be rammed into the earth.

Figure 2:
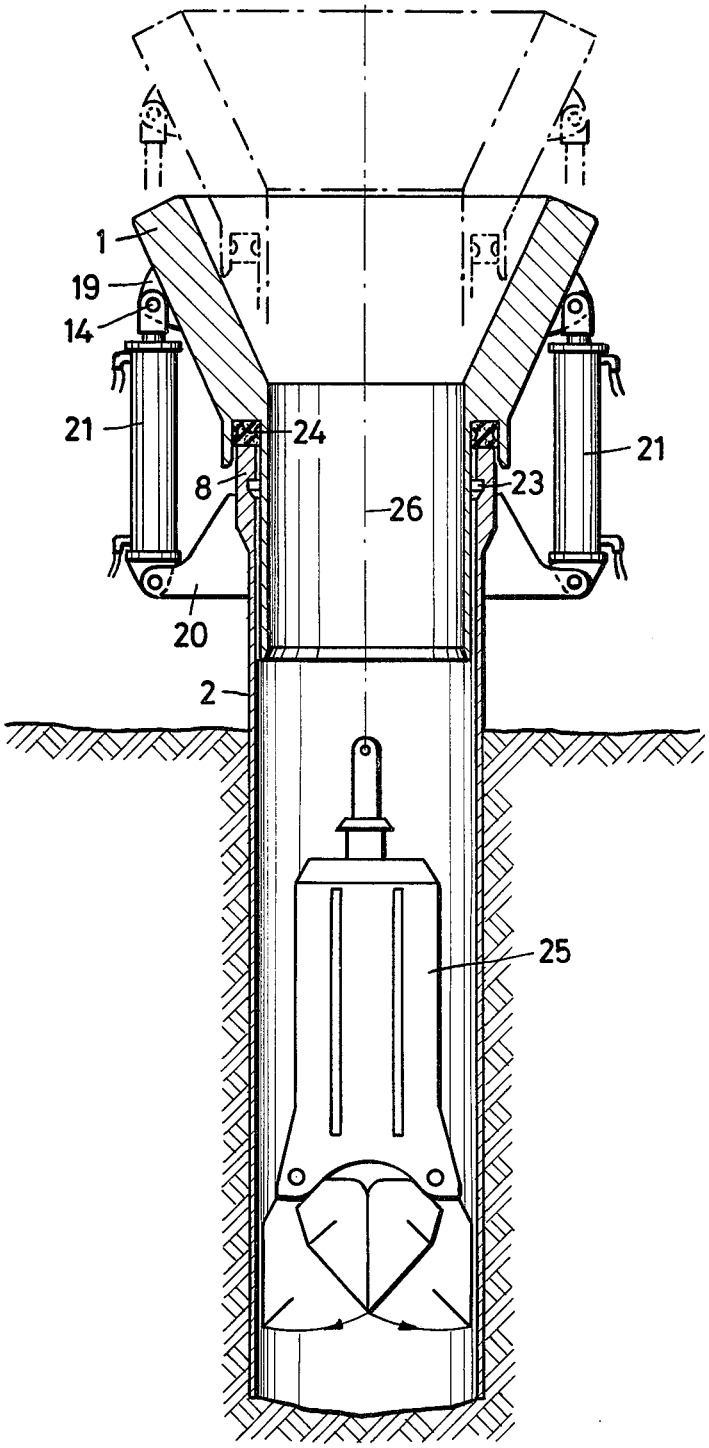

The ramming is performed by lifting the ram 1 by means of the cables 18 and a crane from the position which is indicated by a solid line to the position which is indicated by a dotted line. Then the ram 1 is dropped in a free fall. During this performance the ram 1 is always guided by its cylindrical extension 3 in the part of the installation 7. When the ram 1 is dropped, the buffer 5 contacts the ring-shaped area of the reinforcement 8 of the part of the installation 7 by way of impact. Due to the contact by impact, the buffer 5 is distorted in accordance with its spaces 6 and prevents the origination of an impact-noise, such as is originated when metal surfaces hit one another. When the ram 1 is lifted into the position as indicated by the dotted line, the steel cables 12 are tightened in such a way that the ram 1 cannot be lifted out of the part of the installation 7. When the rammed-in tube 2 serves for the production of a concrete pole, it must be removed from the earth after the concrete has been poured in. For this purpose the ram 1 is transferred in an impact-like fashion by the crane from the position which is indicated by solid lines to the position which is indicated by dotted lines, imparting an upward directed impulse on the tube 2' by means of the tight steel cables 12. The static friction of the tube 2' in the earth is overcome due to this impulse, such that the tube 2' is pulled out of the earth to a certain extent. Then the ram 1 is lowered slowly by the crane to the position which is indicated by solid lines and again lifted in an impact-like fashion by the cables 18, imparting intermittent removal-impulses on the tube 2', which enhance the removal and make the utilization of a crane of relatively small capacity possible. At the inner surface of the reinforcement 8 of the part of the installation 7 a ring-shaped groove 23 is located. This groove 23 serves a purpose, which will be described later. The ram 1 is equipped with a cylindrical opening 24, which is an extension of the cone 11, and which serves for the introduction of the earth remover 25 (FIG. 2). In this way the removal of the earth can be done concurrent with the ramming. The version as shown in FIG. 1 necessitates the use of a crane, which is equipped with two ropes. One of these ropes serves for the performance of the ramming operation, and the other rope serves for the operation of the earth remover 25.

FIG. 2 is the same as FIG. 1, except that piston-cylinder arrangements 21 are provided instead of the steel cables 12, which are located on brackets 19, 20, which brackets 19, 20 are attached diametrically to the ram 1 and the tube 2 in such a way that they are located parallel to the axis of the tube 2. For this version a crane with only one rope 26 can be used. The tube 2 which is equipped with the ram 1 and the piston-cylinder arrangements is erected by means of the rope 26, which is attached to the ram 1 and is maintained in this position until it stands up due to partial ramming. The ramming is performed exclusively by activation of the piston-cylinder arrangements 21, by means of which the ram 1 is lifted from the position which is indicated by solid lines to the position which is indicated by dotted lines and is dropped by releasing the air from the piston-cylinder arrangements. When the tube stands up, the rope 26 is taken off the ram 1 and attached to the earth remover 25, which now removes the earth from the tube 2 during the ramming, which results from the activation of the piston-cylinder arrangements 21. For the removal of the tube in case of concrete poles, stops, which are not shown, are attached with side arms to the tube. The ram 1 hits these stops when it reaches the dotted position and imparts an upward directed impulse on the tube 2. In addition the ram 1 is attached to the rope 26 during the removal operation, and a slow lowering of the ram 1 by means of the rope 26 is performed with vented piston-cylinder arrangements 21, whereupon by means of activation of the piston-cylinder arrangement 21 an impact impulse in the direction of removal is imparted on the tube 2, when the ram 1 hits the stops, in the same way as shown in FIG. 1.

Figure 3:
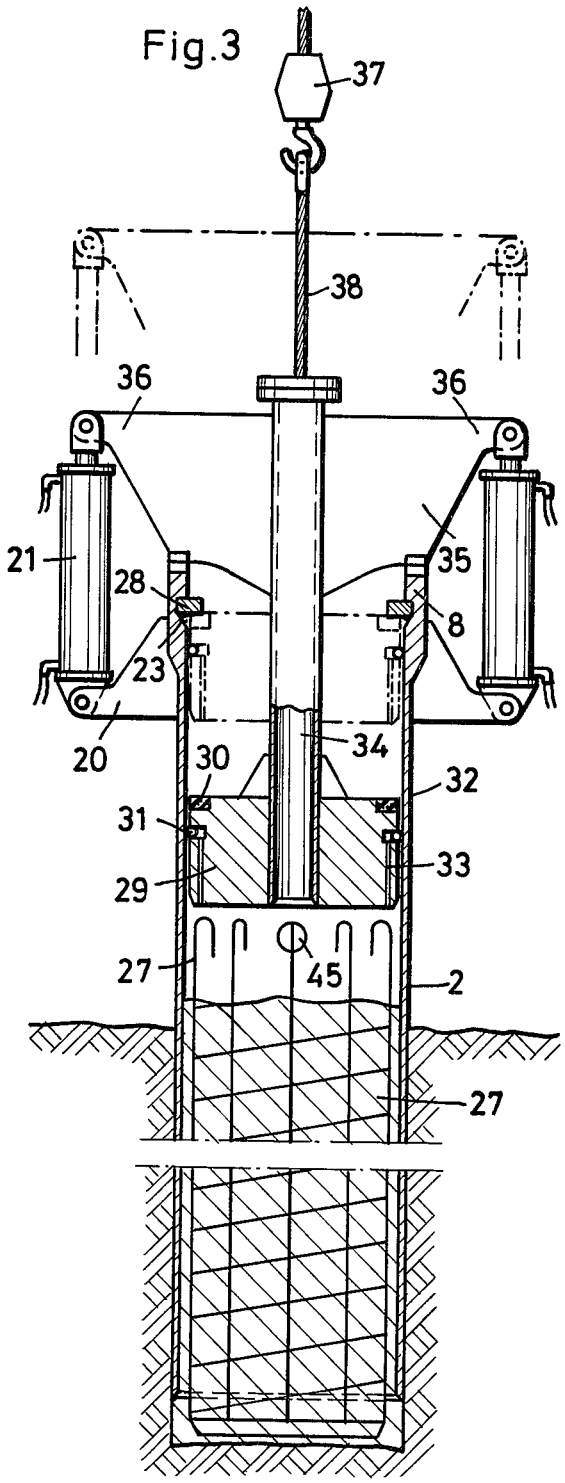
Figure 4:
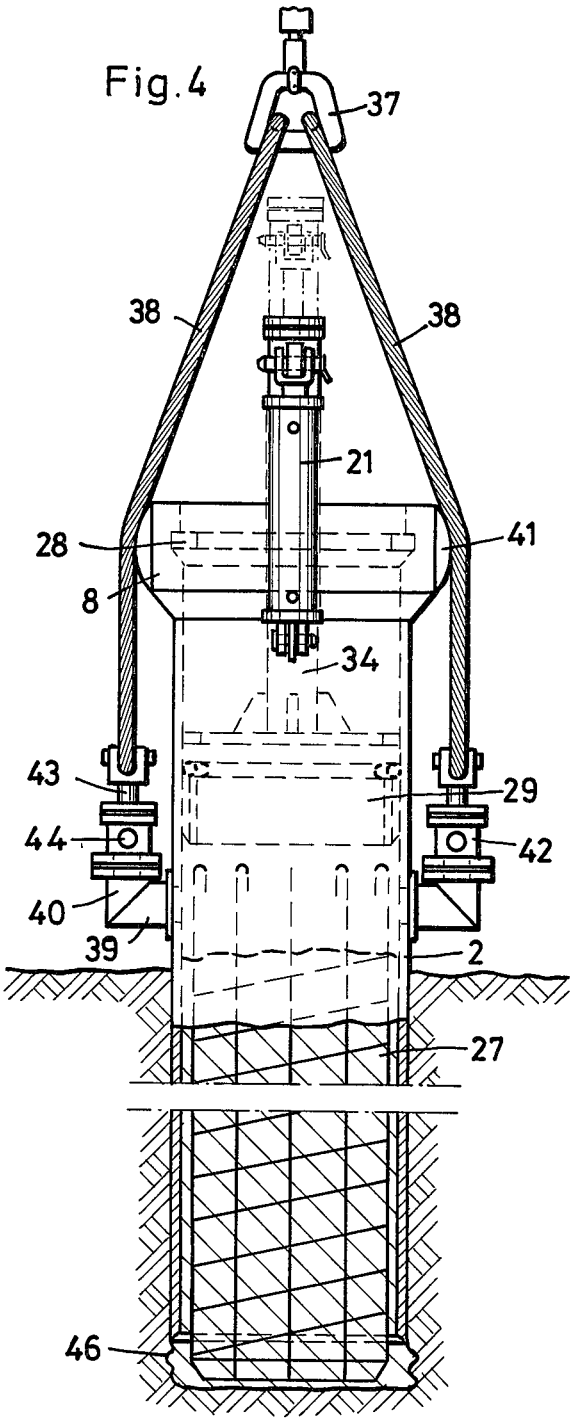

FIGS. 3 and 4 show a varied version of the device, which serves to remove the rammed-in tube 2, which is filled with concrete.

At the inside of the reinforcement 8 of the tube 2, a ring-shaped groove 23 is located, which serves for the reception of a snap ring 28. Before the snap ring 28 is inserted into the groove 23 a compression-and impact-piston 29 is inserted into the tube 2. The compression-and impact-piston 29 is equipped on its upper side with a buffer 30, which serves for the muffling of noise. Below the buffer 30 a ring-shaped groove 32 is located in the compression-and impact-piston 29, in which groove a gasket 31 is located. The bottom of the ring-shaped groove 32 is connected with the lower end of the compression-and impact-piston 29 by means of drilled holes 33, which extend parallel to the axis of the tube 2. A piston rod 34 is attached to the compression-and impact piston 29, which piston rod 34 is directed upward, hollow, and tightly sealed at its free end. At its free end the piston rod 34 is equipped with a cross connection 35. Both ends 36 of the cross connection 35 are attached to the piston rods 34 of the piston-cylinder arrangements 21. The pistons of the piston-cylinder arrangements 21 are attached to the brackets 20, which in turn are attached to the tube 2. Two pulling ropes 38 are attached at the hook 37, as shown in FIG. 4. The pulling ropes 38 are placed over rounded-off shoulders 41 of the reinforcement 8 of the tube 2. Two tube-like legs 39 are attached to the tube 2 diametrically and opposite each other. The parts of the legs 39, which are directed vertically upward 40, contain safety valves 42, which are actually known. The pulling ropes 38 are attached to the valve lifter 43 of the safety valves 42 and maintain their valve heads in a closed position, due to the effect of the pulling ropes 38 and due to the air pressure in tube 2. If the tension of the pulling ropes 38 lessens during the upward movement of the tube 2, the safety valves 42 are opened, and the air pressure in the tube is released through the vents 44. During removal the tube 2 is under the influence of the tension of the pulling ropes 38, which is directed toward the direction of removal. For the compression of the concrete 27 the cross connection 35 and along with it the compression-and impact-piston 29 are lowered by means of the piston-cylinder arrangements 21. In this way the atmosheric air which is contained in the tube between the compression-and impact piston 29 and the surface of the concrete 27 is compressed to form a pocket of compressed air, which compresses the concrete 27 and presses the concrete 27 below the tube 2 in the form of a shoulder into the earth, as shown at 46 in FIG. 4. During this downward movement the piston 29 has the effect of a compression piston on the concrete. Then the piston 29 is moved upward to the position indicated by the dotted line (FIG. 3) in an impact-like fashion by means of the piston-cylinder arrangements 21. Now as the air pocket in the tube 2 is relieved, the buffer 30 contacts the snap ring 28 in an impact-like fashion and imparts an upward movement on the tube 2. The magnitude of the upward movement is limited by the safety valves 42, which open when the tension of the ropes 38 lessens. During the upward movement the piston 29 acts as an impact piston. By means of intermittent downward movement and upward movement of the compression-and impact-piston 29, a compression of the concrete 27 as well as an impact in the direction of removal on the snap ring 28 of the tube 2 results from every activation of the piston 29. In this way the tube 2, which is held by the pulling ropes 38, is removed intermittently in a jerking fashion; and the concrete forms shoulders 46 in the earth, which are pointed outward and are located one above the other. On account of these shoulders 46 the grip of the concrete in the earth is substantially increased and, thus, the capacity of the compressed concrete pole is increased. A closable air vent 45 is located in the tube 2 below the compression-and impact piston 29, which is opened at certain intervals of time in order to prevent the creation of low pressure in the tube 2 with progressing removal.

Figure 5:
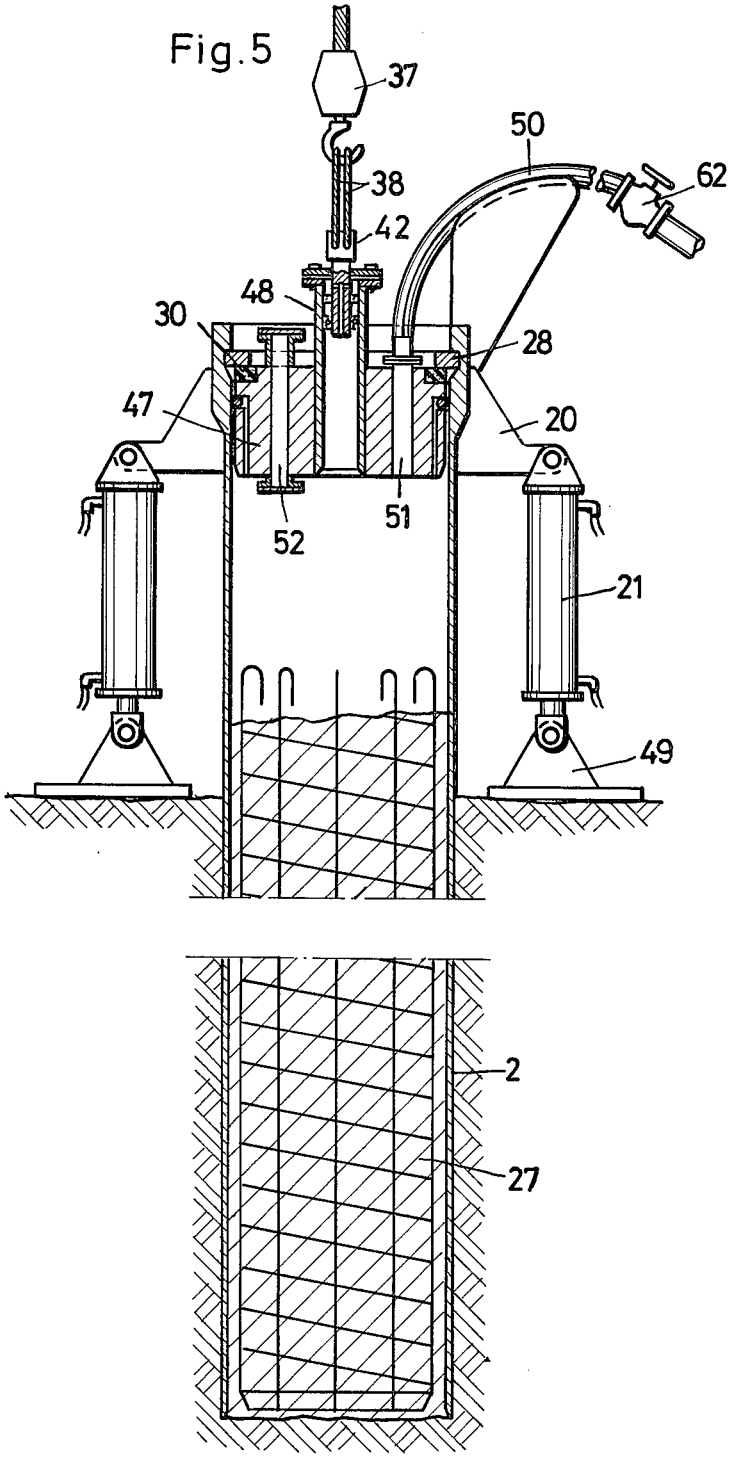
Figure 6:
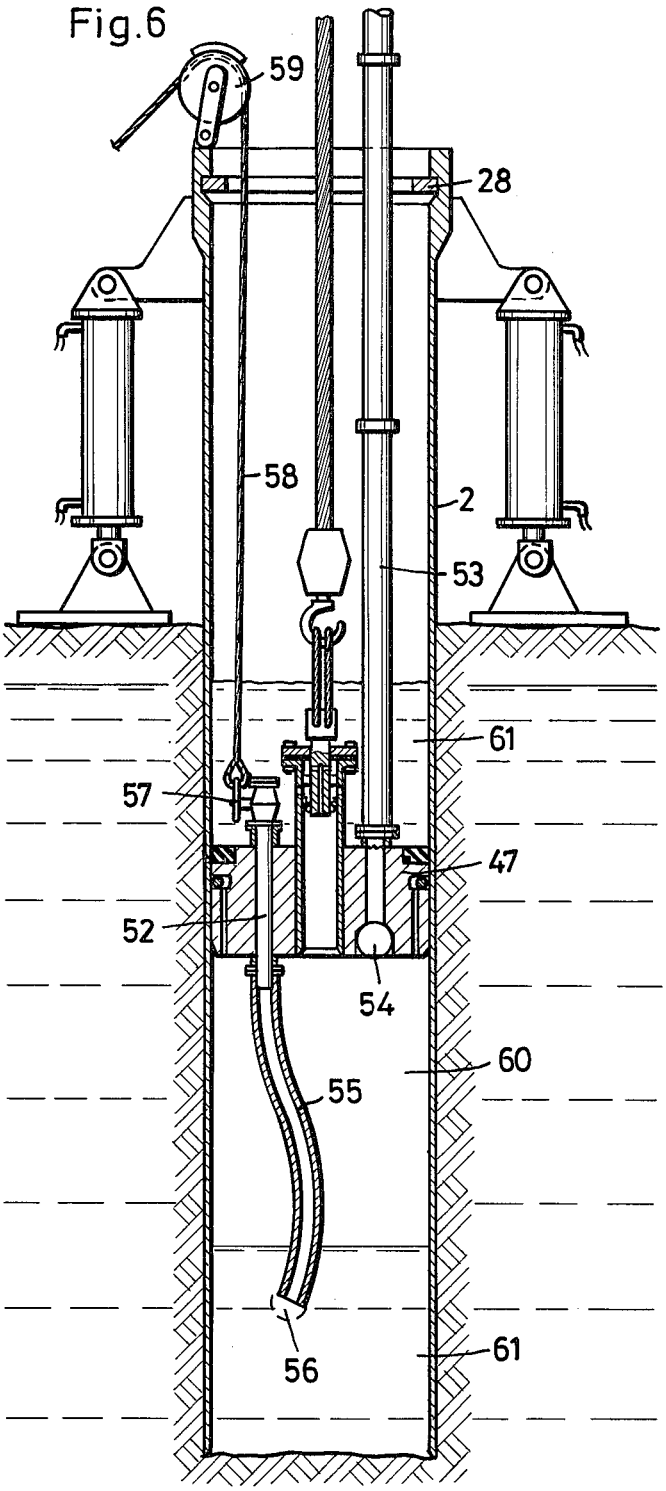

The FIGS. 5 and 6 show another variation of the device, which is suitable for the production of compressed concrete poles in the ground water. As can be seen in FIG. 5, the piston-cylinder arrangements at the flanges 20 of the tube 2 are directed vertically downward, and their piston rods are equipped with supporting feet 49, which stand on the ground. The compression-and impact-piston 47 is located in the same way in the tube as shown in FIG. 3, except that the safety valve 42 is located in the end of the piston rod 48. The pulling ropes 38 of the crane hook 37 are attached to the valve lifter of the safety valve. The compression-and impact-piston 47 works in the same way as described for FIG. 3, except that its intermittent upward and downward movements are the result of the tightening or loosening movements of the crane hook 37. In this way the weight of the compression and impact piston 47 must be such that on the one hand during the lowering phase the formation of an air pocket occurs, which serves for the compression, and on the other hand an upward directed movement is imparted on the tube 2 during the lifting in an impact-like fashion. Again in this case the safety valve 42 serves as a safety measure against a too big movement of the tube 2 out of the earth. A drilled hole 51 is located in the compression-and impact-piston 47, which drilled hole is equipped with an air line 50, which air line is equipped with a valve 62, and which serves to maintain atmospheric pressure in the tube 2. Valve 62 is opened for a short time when a lower pressure occurs in tube 2 during the removal of tube 2.

Another opening 52 is located in the compression-and impact-piston 47, which is closed on both ends during the removal of tube 2. The function of the opening 52 is described in the description for FIG. 6. The piston-cylinder arrangements 21 enhance the tractive power, which is imparted by the pulling ropes 38, at least in the beginning phase of the removal. In this case appropriate layers of material can be put between the supporting feet 49 and the ground in order to enhance the removal of the tube 2 in the beginning phase for 2 to 3 meters.

FIG. 6 shows the removal of the ground water 61 from a rammed-in tube 2 using the device according to FIG. 5. A concrete pipe 53 is attached to the compression-and impact-piston 47, which is closed at the lower end of the compression-and impact-piston 47 by means of a sphere, which consists of rubber or Styrofoam. A flexible hose 55 is attached at the lower end of the opening 52, which opening 52 is open at both ends, and which flexible hose 55 is equipped at the end with a basket, which is immersed in the ground water 61. At the upper end of the opening 52 a valve 57 is located, which can be opened by a rope 58, which rope 58 is passed through a pulley 59.

When the tube 2 is rammed-in, the compression-and impact-piston 47 is inserted into tube 2 in the way described for FIG. 3, after the concrete pipe 53 is closed by means of sphere 54. Then the compression-and impact-piston is lowered, until an air pocket has been formed between the compression-and impact-piston and the surface of the ground water, which air pocket exceeds the hydrostatic pressure of the ground water 61. Then the valve 57 is opened by means of the rope 58, in such a way that with further lowering of the piston the ground water 61 is transferred to the surface of the compression-and impact-piston 47 by means of the hose 55, which serves as a connecting tube. The ground water 61, which collects above the compression-and impact-piston 47, adds additional weight to the compression-and impact-piston 47, which will cause further lowering of the piston 47, and all the ground water 61 below the piston is transferred above the piston 47 by means of the tube 55 or hole 52. When the entire ground water 61 which was located below the compression-and impact-piston in the tube 2 is removed in this way, the valve 57 is closed. Then concrete is pumped into the tube 2 through the concrete pipe 53 and against the pressure of the air pocket, which exists below the compression-and impact-piston 47, in such a way that the air pocket 60 as well as the compression-and impact-piston 47 are gradually lifted. In this way the ground water 61, which is located above the compression-and impact-piston 47, flows over the end of tube 2 and exits outside. When the tube 2 is filled with concrete in this way, the concrete pipe 53 is removed; and the corresponding drilled hole is closed air tight at the top, and the compression-and impact-piston 47 is removed from the tube 2 in order to be able to remove the flexible hose 55 and to close the opening 52. Then the compression-and impact-piston 47 is again inserted into the tube, and the snap ring 28 is inserted; and the compression-and impact-piston 47 is moved up and down intermittently, as described for FIG. 5, in order to compress the concrete 27 on the one hand and to impart impacts in the direction of removal on the tube 2 by way of the snap ring 28. This intermittent lifting movement of the compression-and impact piston 47 is continued until the tube 2 is removed to such an extent that the tube 2 can be removed completely from the earth solely with the pulling ropes 38.

What is claimed is as follows:

1. A device for the production of earth holes and poles, which are located in these holes, which poles are made of poured or compressed concrete, said device comprising a ram equipped with an axial, cylindrical opening, an earth remover insertable in said opening for the concurrent removal of the earth by means of said earth remover; a tube, said ram further comprising a cylindrical extension which is inserted into said tube and serves to guide the ram during its ramming movements, which ram can be lifted and lowered by a crane, and which ram is brought into contact with the frontal plane of the tube characterized by the fact that the tube is connected in a disconnectable fashion with the ram by means of yielding devices, which determine the lifting height of the ram, a ring-shaped shoulder formed on the ram and having a groove for the reception of a noise-muffling buffer and for the reception of the frontal plane of the tube; said tube having a groove formed on the inner surface thereof, a snap ring in said groove to define a stop; and an axially movable compression-and-impact-piston tightly contained in the tube below the snap ring.

2. The defined in claim 1, further comprising flexible steel cables, said device being characterized by the fact that the ram and the tube are equipped with at least two brackets, which brackets are located diametrically opposite each other, for the removable reception of said flexible steel cables, which steel cables correspond in their length with the lifting height of the ram, and that the brackets of the ram are equipped with holes at a place above the point of attachment of the cables, which holes serve to receive pulling ropes, which ropes are adapted to be attached to the hook of a lifting crane.

3. The device defined in claim 1, further comprising a piston cylinder arrangement, said device being characterized by the fact, that the ram and the tube are each equipped with two brackets which are located diametrically between which, said piston-cylinder arrangement are removably attached preferably parallel to the axis of the tube, and that at the upper edge of the ram two diametrically opposite holes are located, which holes serve for the reception of the pulling ropes of a lifting crane.

4. The device defined in claim 1, characterized by the fact, that the upper section of the tube to which the brackets are attached forms an independent part of the device, of a length which exceeds the lifting height of the ram, where tubes of lesser diameter are equipped at their end with conical enlargement, which corresponds with the diameter of the part of the device.

5. The device defined in claim 4, characterized by the fact, that the ends of the part of the device and the tube which are located next to each other, are equipped with externally protruding ring flanges with conically tapered outer surfaces and with grooves located in their inner surfaces, which grooves serve to receive a gasket and that a tightening device is provided, which is equipped at the separating point with a tightening bolt, which bolt is located tangentailly with referrence to the tube.

6. The device defined in claim 1, characterized by the fact, that the buffer consists of a elastic incompressible material, and fills the cross-section of the groove which receives it and posseses space at its sides, which are located parallel to the axis of the tube, and which spaces determine the distance that the buffer can be compressed.

7. The device defined in claim 4, characterized by the fact, that stops are attached to the tube on to the part of the device, which stops protrude into the upper section of the lifting distance of the ram.

8. The device defined in claim 3, characterized by the fact, that the piston-cylinder arrangements can be turned down 180° at their brackets, which brackets are located at the tube on at the part of the device.

9. The device defined in claim 1, characterized by the fact, that the compression-and-impact-piston is equipped on its surface with a nose muffling buffer, which can be brought into contact with the snap ring.

10. The device defined in claim 9, characterized by the fact, that below the buffer a ring-shaped groove is provided in the compression-and-impact-piston, which groove serves for the reception of a gasket, and the bottom of which ring-shaped groove is connected with the bottom of the piston by means of axially drilled holes.

11. The device defined in claim 10, characterized by the fact, that the compression-and-impact-piston is equipped with a piston rod, which is connected at its free end to the middle of a transverse cross connection; both ends of which are connected to the free ends of the piston-cylinder arrangements, which are located at the tube, and that at the wall of the tube, pulling ropes are located, which are located at an angle of 90° with reference to the cross connection and diametrically with reference to each other and which pulling ropes are attached to the hook of a lifting crane.

12. The device defined in claim 11, characterized by the fact, that for the reception of the pulling ropes, tubular legs are attached to the walls of the tube, which tubular legs are pointed upward in a right angle and valves disposed in said tubular legs and operatively connected to said rope such that said valves open when the pulling ropes are released.

13. The device defined in claim 11, characterized by the fact, that pulling ropes are attached to the compression-and-impact-piston, which pulling are attached to the hooks of a crane, that the compression-and-impact piston possesses a weight, which serves to attain a pocket of compressed air, and that the piston-cylinder arrangements which are attached to the tube are turned downward and are supported with their free ends on the ground with the aid of supporting legs, which are of variable height.

14. The device defined in claim 13, characterized by the fact, that the compression-and-impact-piston is equipped with an air line, which premeates it and which the air line is equipped with a closing valve.

15. The device defined in claim 14, characterized by the fact, that in the compression-and-impact-piston has a safety valve which opens when the pulling ropes are released.

16. A process for the production of poles made of compressed concrete employing a device having a tube and a ram for ramming said tube into the ground, said process including the application of a force in the direction of the removal of the tube, which tube is rammed-in and filled with the concrete to be compressed, and which process includes the formation of an air pocket above the column of concrete, which is contained in the tube, characterized by the fact, that subsequent to each compression of the air pocket, there is an impact impulse in the direction of the removal of the tube, and characterized by the fact, that for tubes which reach down to ground water, a pocket of compressed air is lowered in the tube, that the ground water, which was replaced by the air pocket is lifted to a position above the air pocket, that after removal of the ground water from the tube concrete is introduced into the tube against the pressure of the air pocket with gradual lifting of the air pocket, and that after introduction of the concrete the air pocket is moved downward intermittently and each time subsequently the tube is subjected to an impact impulse in the direction of removal.

17. A device for the production of earth holes and poles, which are located in these holes, which poles are made of poured or compressed concrete, said device comprising a ram equipped with an axial, cylindrical opening, an earth remover insertable in said opening for the concurrent removal of the earth by means of said earth remover; a tube, said ram further comprising a cylindrical extension which is inserted into said tube and serves to guide the ram during its ramming movements, which ram can be lifted and lowered by a crane, and which ram is brought into contact with the frontal plane of the tube characterized by the fact, that the tube is connected in a disconnectable fashion with the ram by means of yielding devices, which determine the lifting height of the ram, a ring-shaped shoulder formed on the ram and having a groove for the reception of a noise-muffling buffer and for the reception of the frontal plane of the tube, and characterized by the fact, that a compression-and-impact-piston is tightly contained in the tube, which is attached to the hook of a crane by means of pulling ropes and which is equipped with a safety rod, which compression-and-impact-piston is equipped with a closeable drilled hole, which permeates the compression-and-impact-piston and which drilled hole is equipped at the side facing the ground water with a flexible tube, which tube runs beneath the level of ground water and which compression-and-impact-piston is equipped with a closeable tube, which serves for the introduction of concrete and the compression-and-impact-piston is equipped with a closeable air line, which permeates it.

* * * * *

UNITED STATES PATENT AND TRADEMARK OFFICE

CERTIFICATE OF CORRECTION

PATENT NO. : 4,106,298

DATED : August 15, 1978

INVENTOR(S) : Hans Mathieu and Jurgen Hockstrasser

It is certified that error appears in the above-identified patent and that said Letters Patent are hereby corrected as shown below:

Column 8, line 4, following second occurrence of "the" please delete "part mid-section" and insert --mid-section part--;

Column 8, line 47, following "tube" please delete "2" and insert --2'--.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*